US005341579A

United States Patent [19]

Schiel et al.

[11] Patent Number: 5,341,579

[45] Date of Patent: Aug. 30, 1994

[54] DEVICE FOR REMOVING A WEB FROM A DRYING CYLINDER

[75] Inventors: Christian Schiel, Heidenheim; Gerhard Kotitschke, Steinheim; Karl Gröner, Heidenheim, all of Fed. Rep. of Germany

[73] Assignee: J. M. Voith GmbH, Fed. Rep. of Germany

[21] Appl. No.: 989,207

[22] Filed: Dec. 11, 1992

[30] Foreign Application Priority Data

Dec. 14, 1991 [DE] Fed. Rep. of Germany ..... 4141296

[51] Int. Cl.[5] ..... F26B 13/30

[52] U.S. Cl. ..... 34/115; 34/117; 34/120

[58] Field of Search ..... 34/115, 116, 117, 120, 34/114, 23, 16, 122, 123

[56] References Cited

U.S. PATENT DOCUMENTS

| | | | |
|---|---|---|---|
| 4,359,828 | 11/1982 | Thomas | 34/117 |
| 4,698,918 | 10/1987 | Kotitschke et al. | 34/117 |
| 4,856,205 | 8/1989 | Meyer et al. | 34/114 |
| 4,932,138 | 6/1990 | Liedes et al. | 34/120 |
| 5,068,980 | 12/1991 | Müller | 34/117 |
| 5,086,571 | 2/1992 | Hietanen | 34/120 |
| 5,115,581 | 5/1992 | Viitanen | 34/117 |
| 5,163,236 | 11/1992 | Heikkilä | 34/117 |

FOREIGN PATENT DOCUMENTS 9012151 10/1990 PCT Int'l Appl. .

*Primary Examiner*—Denise Gromada

*Attorney, Agent, or Firm*—Ostrolenk, Faber, Gerb & Soffen

[57] ABSTRACT

In a paper making machine a porous support belt travels together with the web over a drying cylinder and leaves the cylinder at a point of removal. A suction box provided in the region of the web removal has a suction zone which is defined by means of two yieldable sealing strips which extend transversely to the direction of travel of the web, and each is supported in a sealing strip holder. The distance between each sealing strip holder and the outer surface of the drying cylinder amounts to at least 30 mm, and each of the yieldable sealing strips has, in its normal condition of operation, such an inherent stiffness that the sealing strip remains substantially free of deformation in the event of a difference in pressure of 0.01 to 0.1 bar between the suction zone and its surroundings.

28 Claims, 3 Drawing Sheets

Fig.2
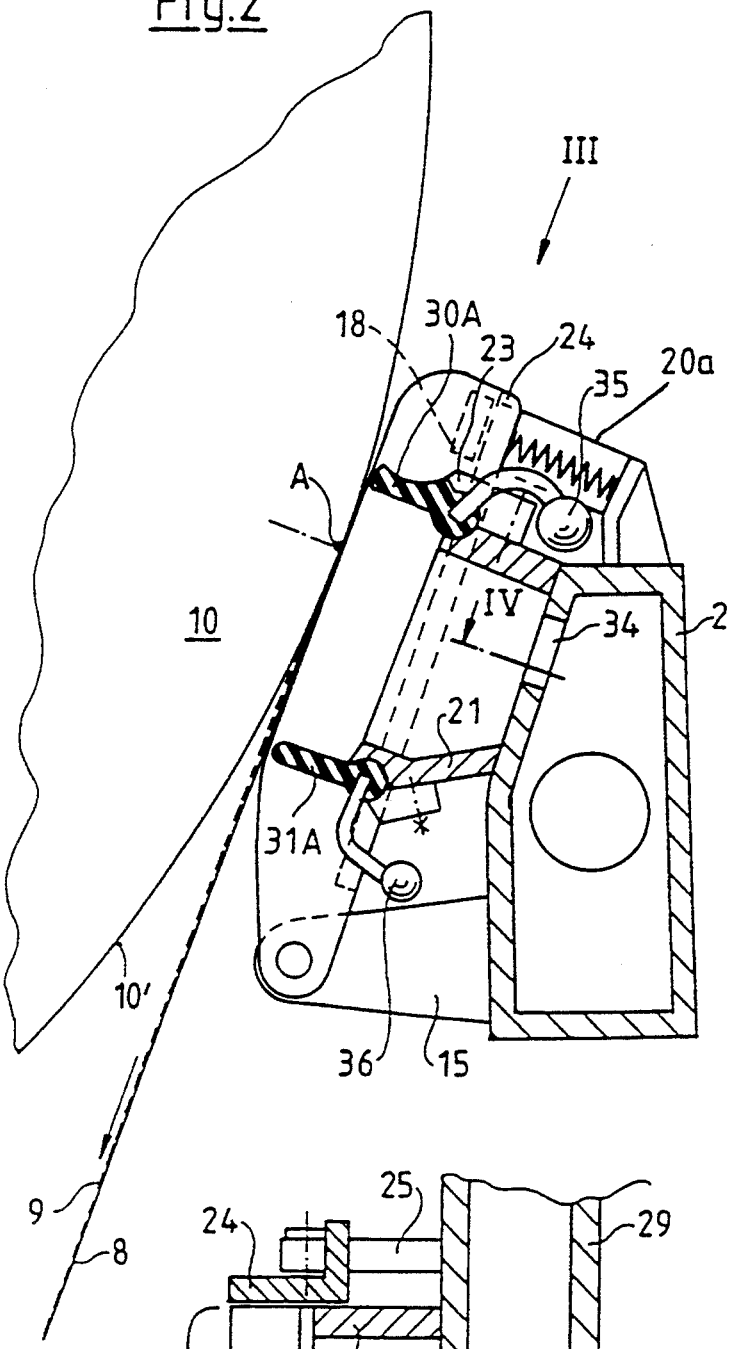
Fig.3
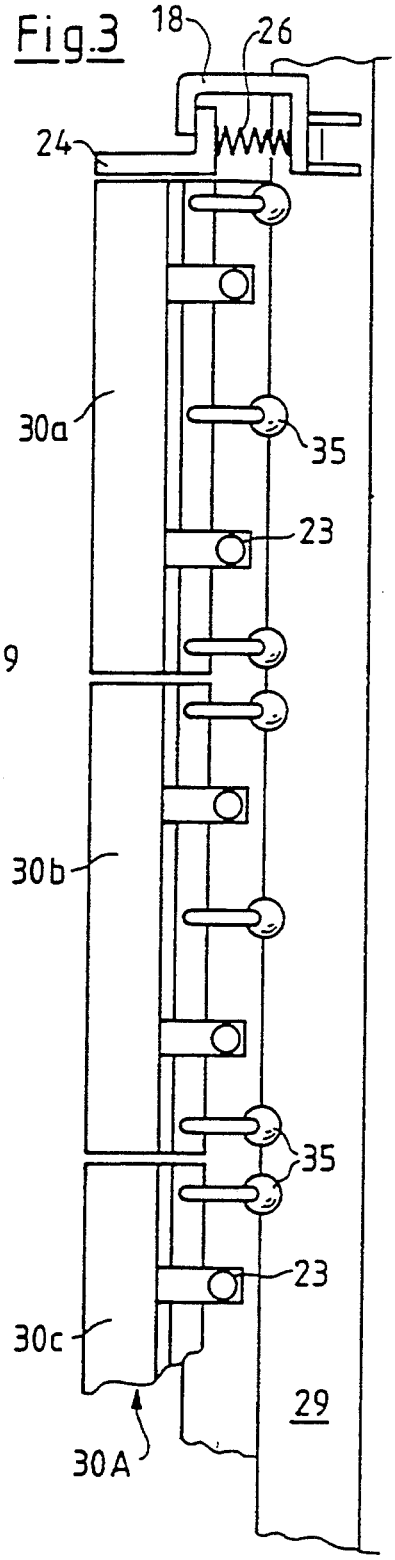
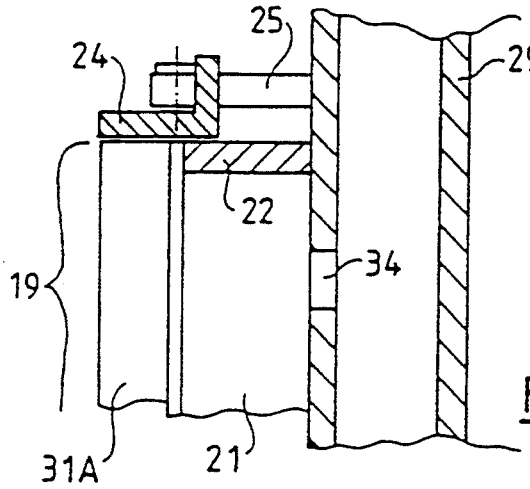
Fig.4

8
44
45
46
41
42
40
43
33
32
10
30C
A
31C
29
8

30B
20B
A
10
34
33
32
29
11
31B
8
10'
37
9
8
9
14
27'
13
12

DEVICE FOR REMOVING A WEB FROM A DRYING CYLINDER

BACKGROUND OF THE INVENTION

The present invention relates to a device for removing a web from a drying cylinder, preferably in a dry end of a machine for the manufacture or treatment of a web of paper, board or the like, and particularly to a device which applies suction for effecting removal of the web from the drying cylinder, and is designed to prevent damage in the event of a disturbance during the web travel, such as the presence of a wad.

The drying section of a paper making machine typically includes at least one and usually a plurality of drying cylinders arranged in sequence of the path of the web. Typically, there is a web support belt that passes the web around successive dryer cylinders. In some arrangements, there is a generally unheated support belt guiding, reversing roll disposed between neighboring drying cylinders in the path of the web through the drying section. The support belt partially wraps around each of the drying cylinders. The web is supported on the side of the support belt so that the web directly contacts the drying cylinders, while the web travels on the opposite outer side of the support belt around the reversing rolls. Typically, the reversing rolls are suction rolls.

The web should leave the drying cylinder with the support belt. As described below, appropriate suction means are provided for accomplishing that result.

The starting point for the invention is German DE-OS 39 10 600 which corresponds to International Application WO 90/12151. That reference mentions the problem that the paper web has a tendency to travel initially some distance further with the outer surface of a drying cylinder beyond the desired point of web removal from the drying cylinder and only thereafter does the web again come against the support belt. Such a course of movement of the web is undesirable, because it leads to unstable web behavior and/or because the web is stretched in the length direction at its point of removal from the drying cylinder. This accordingly causes the web to shrink in the transverse direction. In order to avoid these disadvantages, DE-OS 39 10 600 suggests producing a vacuum on the inner side of the support belt in the region where the support belt travels off the cylinder, at the suction box 20 with suction openings 26 and 26' in that reference. Furthermore, a sealing strip is provided which extends transversely over the inner side of the wire support belt shortly in front of the point of removal. This strip deflects the air boundary layer which arrives together with the support belt, since otherwise the vacuum could not be produced.

Another known device attempts to draw the web of paper against the support belt as close as possible to the point of removal of the support belt from the drying cylinder comprises a so-called web stabilizer. This is shown in Federal Republic of Germany Patent 37 06 452, which corresponds to U.S. Pat. No. 4,856,205.

In both of these known devices, the vacuum produced at the point where the support belt travels off the drying cylinder is not always sufficient to assure dependable guidance of the web of paper. Furthermore, in rare cases, a foreign body, for instance, a wad of fibers, is brought, together with the web of paper, between the drying cylinder and the support belt. It becomes jammed there at the strip. This presents a danger of the support belt being destroyed. A similar disturbance occurs if the drying cylinder becomes "wrapped-up" in the event of a tear in the web, i.e., if the web winds up in an undesired manner on the drying cylinder.

In order to avoid these dangers, which may result from the above noted disturbances, U.S. Pat. No. 4,359,828, FIGS. 4 to 6, proposes to make a sealing strip flexible so that it can move away from a wad which arrives together with the web. Furthermore, in that case, a part of the front wall of a suction box is mounted movably and is pressed against the support belt under the force of a spring. This enables this part of the wall to also move out from a foreign body. In FIG. 3 of U.S. Pat. No. 4,359,828, a suction zone for a relatively high vacuum is defined, near the place where the support belt runs off the cylinder, by two yieldable sealing strips which extend transversely to the direction of travel of the web. Each sealing strip is supported in a respective sealing strip holder.

SUMMARY OF THE INVENTION

The present invention is concerned with improving the arrangement in the manner that the distance between the sealing strip holders and the outer surface of the cylinder may be enlarged while the vacuum in the suction zone can be increased.

Modern paper manufacturing machines, are being operated at constantly increasing speeds. This makes it necessary to increase as much as possible the distance between the support belt, which travels over the outer surface of the cylinder, and the non-flexible parts of the suction box, i.e., in particular, the sealing strip holders. If a disturbance should occur, this would reduce the danger of damage to the support belt or machine parts to a greater extent than previously. This necessity, however, runs counter to another requirement, in which the vacuum in the suction zone should be increased considerably, as compared with what it previously has been. The higher vacuum assures that, even at the highest operating speeds, the web of paper will travel off the drying cylinder only very slightly later than the porous support belt does. The ideal is for the paper web to move off the drying cylinder directly and completely together with the support belt so that any lengthening of the paper web at the run off point is avoided.

According to the invention, the stationary suction box extends from slightly upstream or before the expected point of removal of the web from the drying cylinder to slightly below or downstream of that point of web removal. The suction box has two yieldable sealing strips which extend across the path of the belt and define the suction zone between them around the drying cylinder. Each sealing strip is supported in a respective sealing strip holder at the suction box. One feature of the invention is the greater distance than conventional of the sealing strip holder from the surface of the drying cylinder. This requires that the sealing strips themselves supported in the holders be inherently stiff so that the strips do not to deform in the event of a pressure difference between the inside of the suction zone and the surrounding area, e.g. the ambient environment.

In accordance with a preferred embodiment, a minimum distance of 30 mm, and preferably about 50 mm, is maintained between the rotating outer or peripheral surface of the drying cylinder and the nearest parts of the stationary suction box, particularly the sealing strip holders. However, traditional flexible sealing strips cannot bridge over such a large distance. Due to the existing difference in pressure between the suction zone and the surroundings, the traditional sealing strips would always move inward toward the vacuum source, permitting infiltrating air to enter the suction zone in an impermissible manner. As a result, the required vacuum could not be maintained in the suction zone.

One concept of the invention is to provide the yieldable sealing strips with such inherent stiffness that they do not substantially defoam under the desired normal difference in pressure between the suction zone and its surroundings, which difference is typically between 0.01 and 0.1 bar. The relatively large distance between the surface of the cylinder and the sealing strip holders also makes it possible, if necessary, to introduce a new support belt with the aid of transverse bars. For this purpose, however, the entire suction box can also be temporarily moved a distance away from the cylinder.

Further possibilities for the invention are now described. In a first embodiment, the sealing strips have a permanent relatively high inherent stiffness. In order that the strips be able to evade an oncoming foreign body, they are mounted swingably on the suction box. In a second embodiment of the invention, the sealing strips are divided lengthwise into several strip sections, and each section of the strip is yieldable in itself. This concept can be realized either in the case of traditional elastically deformable sealing strips or in the above mentioned case of the swingably mounted sealing strips. In a third embodiment of the invention, at least one of the two sealing strips has a cavity, which is acted on by a pressurized fluid, such as compressed air, pressurized water, or the like, in the normal condition of operation. Thus, the pressurized sealing strip has the inherent stiffness necessary to maintain the pressure difference between the suction zone and the surroundings without substantial deformation of the sealing strip only during the normal operating condition and therefore only as long as the pressure in the cavity is maintained.

Other objects, features and advantages of the present invention will become apparent from the following description of the invention which refers to the accompanying drawings.

BRIEF DESCRIPTION OF THE DRAWINGS

FIG. 2 shows a web removal device differing from FIG. 1 which is arranged on an individual drying cylinder.

FIG. 3 is a view, seen in the direction of the arrow III in FIG. 2.

FIG. 4 is a partial section along the line IV in FIG. 2.

DETAILED DESCRIPTION OF THE INVENTION

Figure 1:
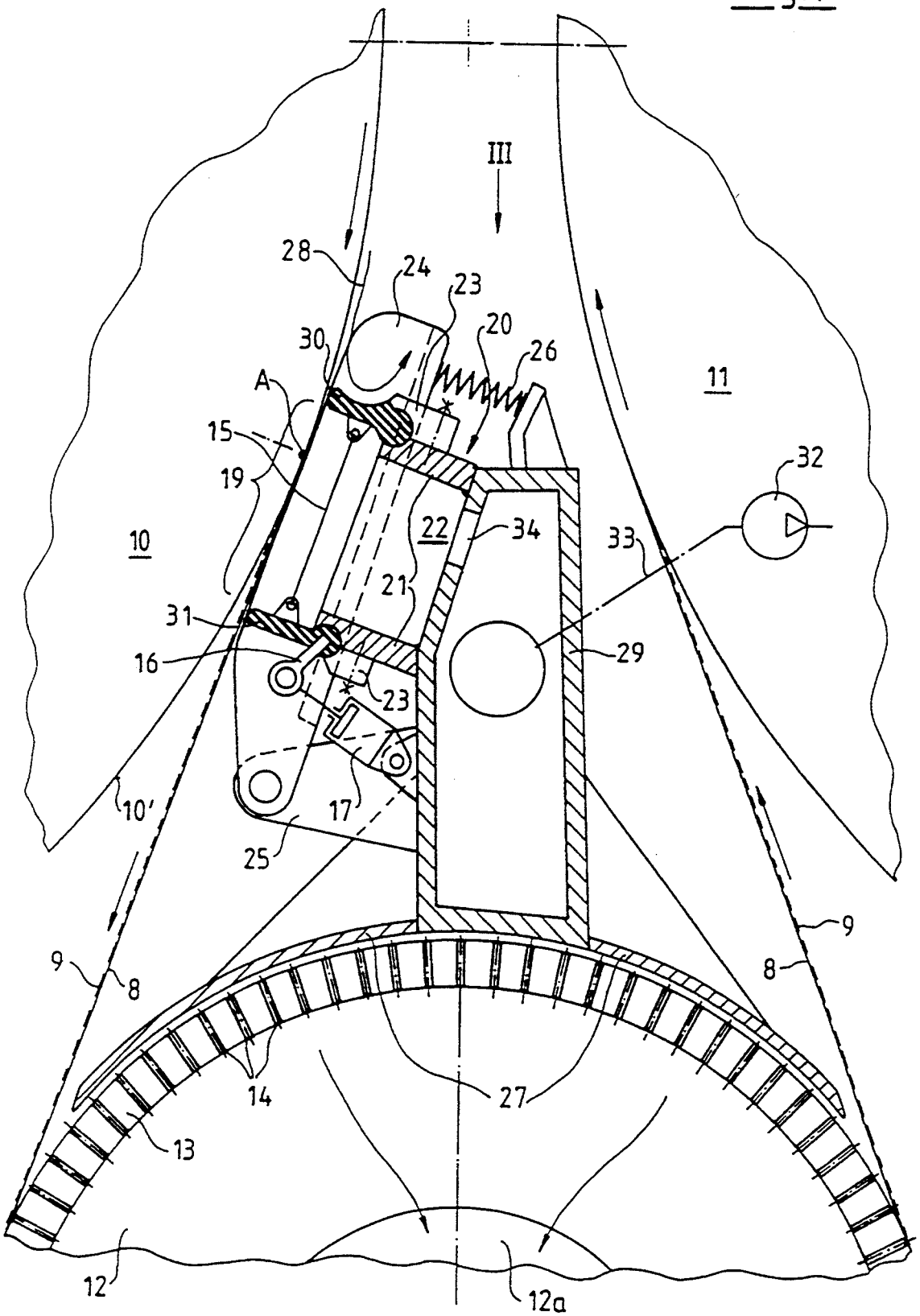
FIG. 1 is a cross section of a web removal device which is arranged in a single wire or single support belt dryer group.

FIG. 1 shows fragments of two drying cylinders 10 and 11 of a single wire dryer group and a reversing roll 12 present between the cylinders. A web of paper 9 which is to be dried travels, together with a porous support belt or wire 8, from the first drying cylinder 10 to the reversing roll 12 and from the latter to the second drying cylinder 11. The reversing roll 12 is developed as a suction roll in order to hold the web of paper 9 fast against the support belt 8 upon their travel together around the reversing roll 12. The shell 13 of the roll is provided with perforations 14. The inside of the reversing roll 12 is free of stationary inserts. Drawing off a vacuum from the inside of the roll takes place through a hollow journal 12*a* in the roll.

A suction box 20, which is open toward the support belt, is provided in the region of the point A where the support belt 8 separates from the first drying cylinder 10. The suction box is fastened to a crossbeam 29 which extends transversely through the "pocket" which is defined by the drying cylinders 10, 11, the support belt 8, and the reversing roll 12. The crossbeam 29 is fastened on longitudinal supports (not shown) on both sides of the paper machine. The suction box 20 limited by two longitudinal walls 21, which are rigidly fastened to the crossbeam 29, and by similar end walls 22. The longitudinal walls 21 extend transversely to the direction of travel of the web, substantially over the entire length of the drying cylinder 10, and are provided with formations that are shaped to function as sealing strip holders. Each sealing strip holder formation of walls 21 supports a resilient sealing strip 30, 31 over the entire transverse length across the support belt.

The yieldability of the sealing strips 30, 31 is primarily assured in the embodiment of FIG. 1 by the fact that the strips are mounted swingably on the sealing strip holder formations of longitudinal walls 21. For this purpose, a round bar is developed on each sealing strip. The bar fits into a rounded recess which is provided between each longitudinal wall 21 and a plurality of bearing blocks 23 which are distributed over the length. The suction zone 19 which is limited by the sealing strips 30, 31 lies, as seen in the direction of the travel of the web, in part in front of or upstream of the run-off point A and in part behind or downstream of the point A.

At both of its ends, the suction zone 19 is terminated by a swingable end wall 24. This end wall is mounted in a bearing bracket 25 and is pressed by a compression spring 26 or by a double acting pneumatic cylinder, not shown in the drawing, against a stop 18 (see FIG. 3). Differing from what is shown in the drawing, the stop 18 can also be adjustable, so that the smallest desired distance can be set between the yieldable end wall 24 and the support belt 8. FIG. 4 shows that the yieldable end wall 24 forms a sealing slot with the ends of the yieldable sealing strips 30, 31 and with the outside of the rigid end wall 22.

In FIG. 1, the swingable sealing strips 30 and 31 are made entirely of a plastic material having good sliding properties so that the support belt 8, preferably a so called dryer wire, can slide, without danger, over the sealing strips in the unusual event that contact should take place. Instead of the round bars formed on the sealing strips, metal shafts, each having a slot in which the sealing strips are fastened, could also be used.

A pneumatic cylinder 17 is indicated diagrammatically. It acts via a lever 16 on the lower sealing strip 31, which, in turn, is coupled by a bar 15 to the upper sealing strip 30. In the event of a disturbance, both sealing strips 30 and 31 are swang out of their normal positions shown in the drawing along the direction of travel of the web and therefore downward in the arrangement shown in FIG. 1.

A curved arrow 28 diagrammatically indicates that the support belt 8 entrains an air boundary layer along with the belt. This layer can be deflected upward by a concavely curved outer surface of the upper sealing strip 30. A vacuum pump 32 is connected via a suction line 33 to the inner space of the crossbeam 29. The beam is connected by openings 34 to the inside of the suction box 20. Cover plates 27 are fastened on the crossbeam 29. The plates extend at a slight radial distance away from and wrap around the part of the circumference of the reversing roll 12 which is free of the partial wrap of the support belt 8.

In the embodiment shown in FIG. 2, only one drying cylinder 10 is present, as occurs, for instance, at the end of a single wire dryer group. Once again, a suction box 20A is provided at the removal point A. This suction box differs from the suction box 20 of FIG. 1 in the following features. The sealing strips 30 and 31, which are again swingable, are provided with weights 35 and 36, respectively. The weights 35 on the upper sealing strip 30 are placed such that the upper sealing strip is held in its normal position, despite the difference in pressure emitting between the inside of the suction box 20A and the surroundings. Smaller weights 36 can be provided on the lower sealing strip 31 since that difference in pressure contributes to holding the sealing strip in its normal position. In the event of a disturbance, if the support belt 8 comes into contact with the sealing strips 30A and/or 31A, the strips move away downward in FIG. 2 until the support belt 8 again assumes its normal path of travel.

As shown in FIG. 3, the upper sealing strip 30A is, for instance, divided over its cross machine length into a plurality of strip sections **30*a*, 30*b*, 30*c***. Each strip section is swingable by itself and can thus move away from an oncoming foreign body independently of the other strip sections.

Figure 6:
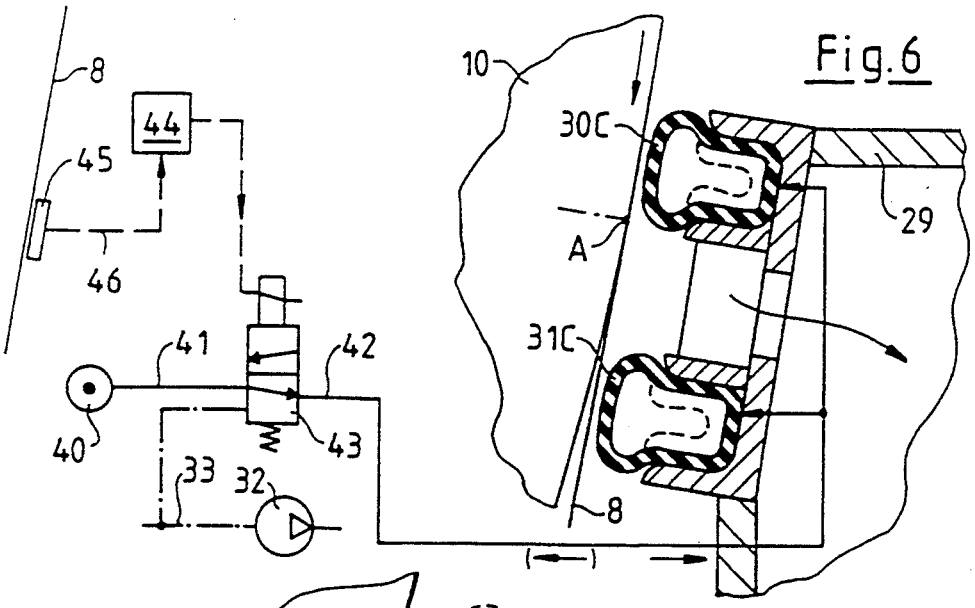
FIGS. 5 and 6 show two different embodiments which differ from FIGS. 1 to 4.
Figure 5:
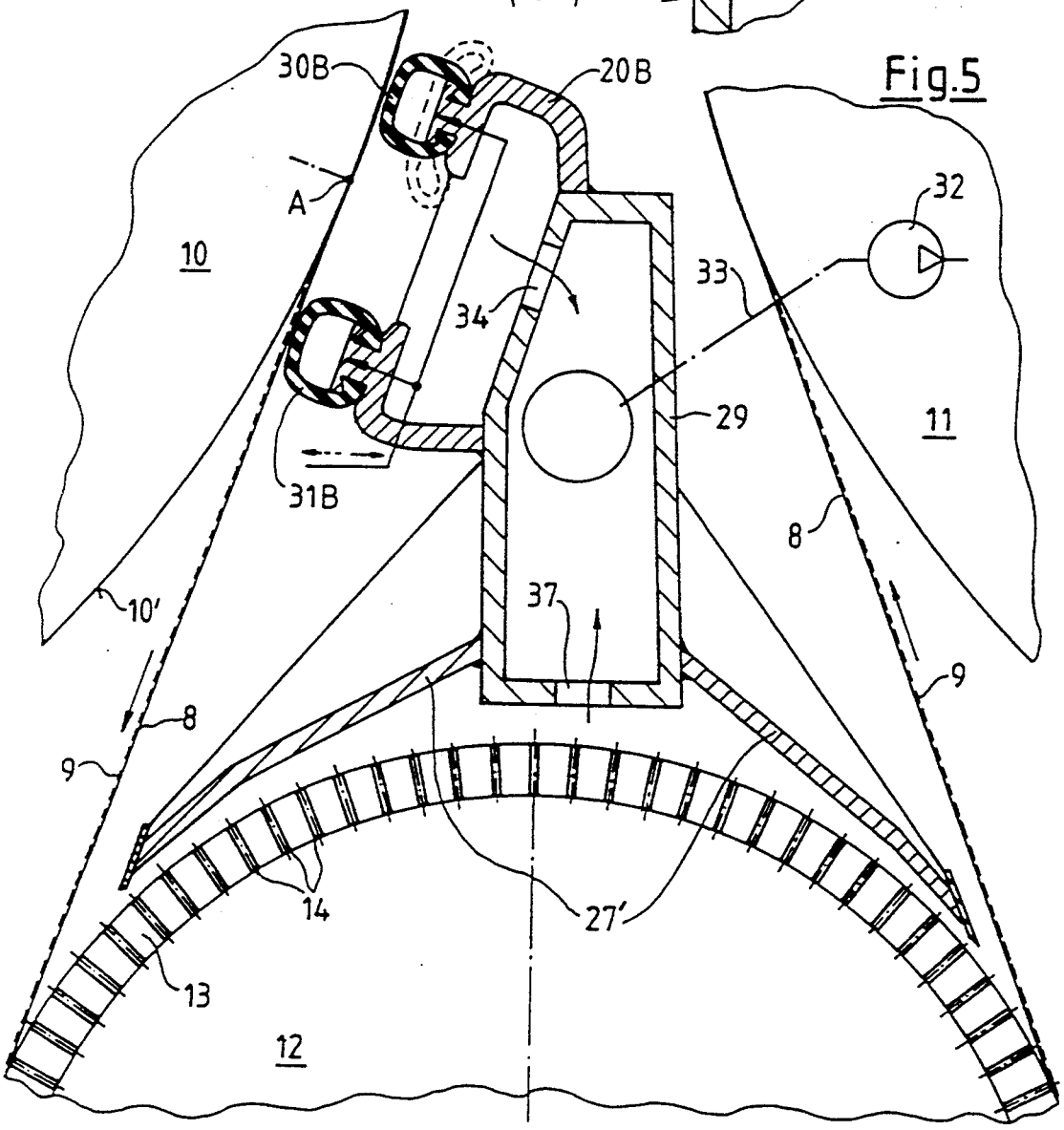

FIGS. 5 and 6 show embodiments in which each of the sealing strips 30B, 30C and 31B and 31C has a respective cavity which can be filled with a pressurized fluid in order to increase the stiffness of the sealing strip. The removable end walls, 24 in FIG. 1, are omitted from FIGS. 5 and 6.

In FIG. 5, the sealing strips 30B, 31B have a generally C-shaped cross section, the arms of which are clamped in the suction box 20B. Each sealing strip thus defines a hollow space. If that space is acted upon by a pressure fluid, via lines 42, (see FIG. 6), then the sealing strip assumes the normal shape shown in solid lines in FIG. 5, and has only a slight distance from the support belt 8. In the event of a disturbance, the pressure prevailing in the cavity or space decreases or the space empties (see FIG. 5), so that the sealing strip assumes a flat shape, as indicated by dashed lines at 30B. Differing from FIG. 1, the crossbeam 29, together with the attached covers 27' over part of the reversing suction roll 12, forms an external suction box which is connected to the inside of the crossbeam 29 via openings 37 and to the vacuum pump 32 via the line 33. There is a common vacuum pump 32 for the reversing suction roll 12 and the suction box 20B. By selecting different sizes and/or numbers of openings 37 and 34, a substantially higher vacuum can be established in the suction box 20B than in the reversing suction roll 12.

In FIG. 6, each of the sealing strips 30C, 31C is developed as a hose. The cavities or spaces defined by the hoses can be filled with a pressurized fluid from a source of pressurized fluid 40 via lines 41, 42 with a control valve 43. A control device 44 receives a signal from a disturbance detector 45 via a line 46 in the event of a disturbance, and the control device generates a control signal which switches the control valve 43 and thereby brings about a decrease in the pressure within the cavity spaces of the tubular sealing strips 30C and 31C. This causes the sealing strips to assume the withdrawn position indicated by dashed lines. The reduction in pressure can take place, by means of the control valve 43, by connecting the cavity spaces with the surroundings, or in the manner shown, so that the cavity spaces are connected via the line 33 to the vacuum pump 32 or to another source of vacuum.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for removing a web from a drying cylinder in a drying section of a paper making machine:

the drying section comprising:

a rotatable drying cylinder having a peripheral surface;

a porous web support belt which passes partly around the cylinder peripheral surface; the belt having a side which supports the web against the drying cylinder peripheral surface as the belt passes around the cylinder;

means supporting the belt to move around the cylinder and to move off the cylinder surface at a removal point around the cylinder;

the removing device comprising:

a stationary suction box extending over the width of the belt, the suction box having a suction zone in the region around the drying cylinder which is also at the opposite sides of the removal point around the cylinder;

first and second yieldable sealing strips between the suction box and the peripheral surface of the cylinder and extending across the direction of belt travel, the strips being spaced apart from each other in the direction around the cylinder and defining the suction zone between them around the cylinder;

a respective sealing strip holder at the suction box for each of the strips; the sealing strip holders being spaced at least 30 mm from the cylinder peripheral surface, and the strips extending from their respective holders toward the cylinder surface for defining the suction zone;

each of the sealing strips being sufficiently stiff as to remain substantially free of deformation as a result of a predetermined pressure difference between the suction zone and the surrounding area; and said sealing strips being constructed to remain substantially free of deformation at a pressure difference between the pressure in the suction zone and in the surrounding area in the range of 0.01 to 0.1 bar.

2. The device of claim 1, wherein the suction box has opposite lateral ends towards opposite lateral sides of the belt, and the suction box has a respective yieldable end wall at each lateral end thereof which is placed and shaped for forming a sealing slot with the support belt for limiting the suction zone.

3. The device of claim 2, further comprising a setting device connected with the end wall for moving the end wall away from the support belt.

4. The device of claim 1, wherein the drying section further comprises:

a second drying cylinder following the first mentioned drying cylinder in the path of the belt through the drying section;

a reversing roll between the first and the second drying cylinders;

the guide means further directing the support belt so that the web on the belt directly contacts the first and second dryer cylinders, while the belt directly connects the reversing roll, and so that the belt wraps around part of the circumference of the reversing roll.

5. The device of claim 4, wherein the reversing roll has a roll shell with recesses defined therein;

a wall supported to the stationary support box and the wall covering the part of the circumference of the roll shell over which the support belt is not wrapped.

6. The device of claim 5, wherein the wall is shaped to define an external suction box communicating with the recesses in the roll shell of the reversing roll.

7. The device of claim 6, wherein the reversing roll is free of other suction connections.

8. The device of claim 5, wherein the roll shell recesses comprise perforations in the roll shell; the reversing roll having an interior connectable to a vacuum source.

9. The device of claim 8, wherein the wall covers over the perforations in the part of the roll shell which is free of the support belt to prevent penetration of infiltrating air.

10. The device of claim 1, wherein one of said strips is disposed substantially upstream of said removal point, another of said strips is disposed substantially downstream of said removal point, and there is substantial spacing between said another of said strips and a vacuum cylinder around which said belt passes while moving downstream of said another of said strips.

11. A device for removing a web from a drying cylinder in a drying section of a paper making machine:

the drying section comprising:

a rotatable drying cylinder having a peripheral surface;

a porous web support belt which passes partly around the cylinder peripheral surface; the belt having a side which supports the web against the drying cylinder peripheral surface as the belt passes around the cylinder;

means supporting the belt to move around the cylinder and to move off the cylinder surface at a removal point around the cylinder;

the removing device comprising:

a stationary suction box extending over the width of the belt, the suction box having a suction zone in the region around the drying cylinder which is also at the opposite sides of the removal point around the cylinder;

first and second yieldable sealing strips between the suction box and the peripheral surface of the cylinder and extending across the direction of belt travel, the strips being spaced apart from each other in the direction around the cylinder and defining the suction zone between them around the cylinder;

a respective sealing strip holder at the suction box for each of the strips; the sealing strip holders being spaced a distance from the cylinder surface, and the strips extending from their respective holders toward the cylinder surface for defining the suction zone;

each of the sealing strips being sufficiently stiff as to remain substantially free of deformation as a result of a predetermined pressure difference between the suction zone and the surrounding area;

said holder of at least said first one of said first and second sealing strips comprising a swingable mount for the respective sealing strip to enable the sealing strip to swing on the suction box.

12. The device of claim 11, wherein the swingable mount enables the respective first sealing strip to swing away from a normal position extending toward the cylinder peripheral surface and toward the travel direction of the belt.

13. The device of claim 12, further comprising means for urging the first sealing strip to restore to its normal position.

14. The device of claim 13, further comprising a stop on the suction box for halting the restoring motion of the first sealing strip when the first strip is at its normal position.

15. The device of claim 14, wherein the urging means comprises a spring.

16. The device of claim 14, wherein the urging means comprises a weight on the strip.

17. The device of claim 12, further comprising a setting device for the first sealing strip for setting the swing position thereof.

18. The device of claim 17, wherein the setting device comprises a pneumatic cylinder device between the first strip and the suction box.

19. The device of claim 17, further comprising control means for sensing a disturbance in the web moving off the cylinder and for generating a control signal for activating the setting device to adjust the position and shape of the sealing strips to accommodate the disturbance without harm.

20. The device of claim 12, further comprising a sealing strip shaft on the first sealing strip and extending over the length of the first strip across the travel direction of the belt, and the shaft being rotatably mounted in the respective sealing strip holder.

21. The device of claim 12, wherein the first sealing strip is subdivided over its length across the travel direction of the belt into a plurality of strip sections each individually swingable.

22. A device for removing a web from a drying cylinder in a drying section of a paper making machine:

the drying section comprising:

a rotatable drying cylinder having a peripheral surface;

a porous web support belt which passes partly around the cylinder peripheral surface; the belt having a side which supports the web against the drying cylinder peripheral surface as the belt passes around the cylinder;

means supporting the belt to move around the cylinder and to move off the cylinder surface at a removal point around the cylinder;

the removing device comprising:

a stationary suction box extending over the width of the belt, the suction box having a suction zone in the region around the drying cylinder which is also at the opposite sides of the removal point around the cylinder;

first and second yieldable sealing strips between the suction box and the peripheral surface of the cylinder and extending across the direction of belt travel, the strips being spaced apart from each other in the direction around the cylinder and defining the suction zone between them around the cylinder;

a respective sealing strip holder at the suction box for each of the strips; the sealing strip holders being spaced a distance from the cylinder surface, and the strips extending from their respective holders toward the cylinder surface for defining the suction zone;

each of the sealing strips being sufficiently stiff as to remain substantially free of deformation as a result of a predetermined pressure difference between the suction zone and the surrounding area;

said device, in order to attain its stiffness, having at least said first one of the first and second sealing strips include a cavity within it for being filled with pressurized fluid, and the first strip is so shaped and the cavity is so shaped and positioned that pressurizing the cavity increases the stiffness of the first strip.

23. The device of claim 22, wherein the first sealing strip includes a hose of flexible material, the hose extending along the length of the first sealing strip, and the hose being pressurizable with fluid and being placed for defining the cavity.

24. The device of claim 22, wherein the first sealing strip includes a generally C-shaped flexible part, which extends along the length of the first sealing strip; the arms of the C being clamped at the suction box for defining the cavity within the C-shaped strip.

25. The device of claim 22, further comprising control means for sensing a disturbance in the web moving off the cylinder and for generating a control signal for decreasing the pressure in the cavity first of the sealing strip.

26. The device of claim 25, wherein the cavity of the first sealing strip is connectable with a source of vacuum by the control means for decreasing pressure in the cavity.

27. The device of claim 25, further comprising a guide extending over the length of one of the sealing strips, and the one strip resting in the guide; the one sealing strip being movable along the guide for installation in and removal from the guide.

28. A device for removing a web from a drying cylinder in a drying section of a paper making machine:

the drying section comprising:

a rotatable drying cylinder having a peripheral surface;

a porous web support belt which passes partly around the cylinder peripheral surface; the belt having a side which supports the web against the drying cylinder peripheral surface as the belt passes around the cylinder;

means supporting the belt to move around the cylinder and to move off the cylinder surface at a removal point around the cylinder;

the removing device comprising:

a stationary suction box extending over the width of the belt, the suction box having a suction zone in the region around the drying cylinder which is also at the opposite sides of the removal point around the cylinder;

first and second yieldable sealing strips between the suction box and the peripheral surface of the cylinder and extending across the direction of belt travel, the strips being spaced apart from each other in the direction around the cylinder and defining the suction zone between them around the cylinder;

a respective sealing strip holder at the suction box for each of the strips; the sealing strip holders being spaced a distance from the cylinder surface, and the strips extending from their respective holders toward the cylinder surface for defining the suction zone;

each of the sealing strips being sufficiently stiff as to remain substantially free of deformation as a result of a predetermined pressure difference between the suction zone and the surrounding area;

at least one of the first and second sealing strips being subdivided over its length across the travel direction of the belt into a plurality of strip sections, each individually movable.

* * * * *